US009429013B2

(12) United States Patent
Wang et al.

(10) Patent No.: US 9,429,013 B2
(45) Date of Patent: Aug. 30, 2016

(54) OPTICAL WINDOW ASSEMBLY FOR AN OPTICAL SENSOR OF A DOWNHOLE TOOL AND METHOD OF USING SAME

(71) Applicant: Schlumberger Technology Corporation, Sugar Land, TX (US)

(72) Inventors: Cong Wang, Sagamihara (JP); Kazumasa Kanayama, Hachioji (JP); Akira Kamiya, Sagamiha (JP); Hua Chen, Yokohama (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 196 days.

(21) Appl. No.: 14/040,726

(22) Filed: Sep. 30, 2013

(65) Prior Publication Data

US 2014/0239168 A1 Aug. 28, 2014

Related U.S. Application Data

(63) Continuation-in-part of application No. 13/776,683, filed on Feb. 25, 2013.

(51) Int. Cl.
*G01N 21/00* (2006.01)
*E21B 49/08* (2006.01)

(52) U.S. Cl.
CPC ..... *E21B 49/08* (2013.01)

(58) Field of Classification Search
CPC ..... G01N 21/00
USPC ..... 356/432, 436
See application file for complete search history.

(56) References Cited

U.S. PATENT DOCUMENTS

| | | | |
|---|---|---|---|
| 4,588,893 | A | 5/1986 | Vidrine et al. |
| 5,167,149 | A | 12/1992 | Mullins et al. |
| 5,201,220 | A | 4/1993 | Mullins et al. |
| 5,331,156 | A | 7/1994 | Hines et al. |
| 5,905,271 | A | 5/1999 | Wynn |

(Continued)

FOREIGN PATENT DOCUMENTS

WO 2014/130916 8/2014

OTHER PUBLICATIONS

International search report and written opinion for the equivalent PCT patent application No. PCT/US2014/017893 issued on Jun. 3, 2014.

(Continued)

*Primary Examiner* — Roy M Punnoose
(74) *Attorney, Agent, or Firm* — Daryl R. Wright; Jody DeStefanis

(57) ABSTRACT

An optical window assembly of an optical sensor of a downhole tool positionable in a wellbore penetrating a subterranean formation. The downhole tool has a housing with a flowline there through to receive downhole fluid therein. The optical sensor is positionable about the flowline to measure light passing therethrough. The optical window assembly includes a tubular sensor body positionable in the housing (the sensor body having a sensor-end and a flanged signal-end with a passage there through), an optical window positionable in the passage of the sensor body to pass the light from the flowline to the optical sensors, a seal disposed about the sensor body, and a backup ring disposed about the sensor body between the flanged signal-end and the seal to support the seal about the sensor body whereby the downhole fluid is prevented from leaking between the seal and the sensor body.

20 Claims, 8 Drawing Sheets

(56) References Cited

U.S. PATENT DOCUMENTS

| | | | |
|---|---|---|---|
| 5,949,536 | A | 9/1999 | Mark |
| 6,587,195 | B1 | 7/2003 | Jennings |
| 7,114,562 | B2 | 10/2006 | Fisseler et al. |
| 7,336,356 | B2 | 2/2008 | Vannuffelen et al. |
| 7,379,180 | B2 | 5/2008 | Vannuffelen et al. |
| 7,458,252 | B2 | 12/2008 | Freemark et al. |
| 7,687,770 | B2 | 3/2010 | Indo et al. |
| 7,969,571 | B2 | 6/2011 | DiFoggio |
| 2004/0218176 | A1 | 11/2004 | Shammal et al. |
| 2007/0108378 | A1* | 5/2007 | Terabayashi ..... E21B 47/011 250/256 |
| 2008/0252881 | A1 | 10/2008 | Yakimoski et al. |
| 2012/0300200 | A1 | 11/2012 | Atkinson et al. |
| 2013/0219997 | A1 | 8/2013 | Sullivan et al. |
| 2014/0240862 | A1* | 8/2014 | Kamiya ..... G02B 5/00 359/894 |

OTHER PUBLICATIONS

Extended European search report for the equivalent European patent application No. 14187107.9 issued on Oct. 21, 2015.

* cited by examiner

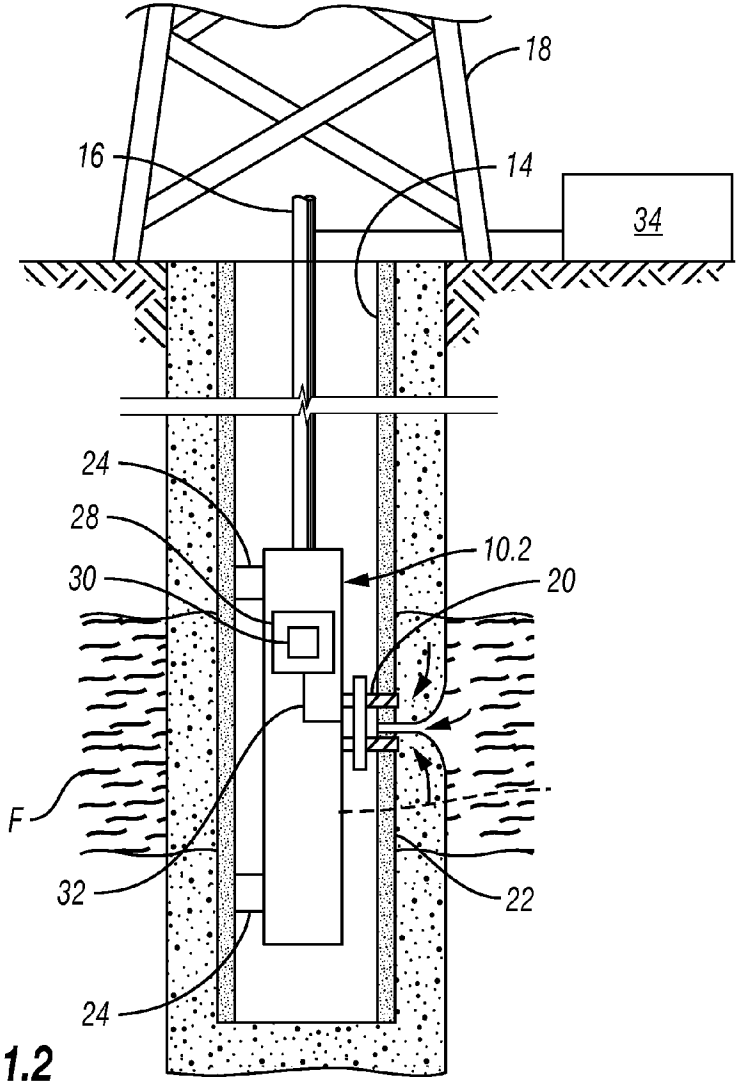
FIG. 1.2
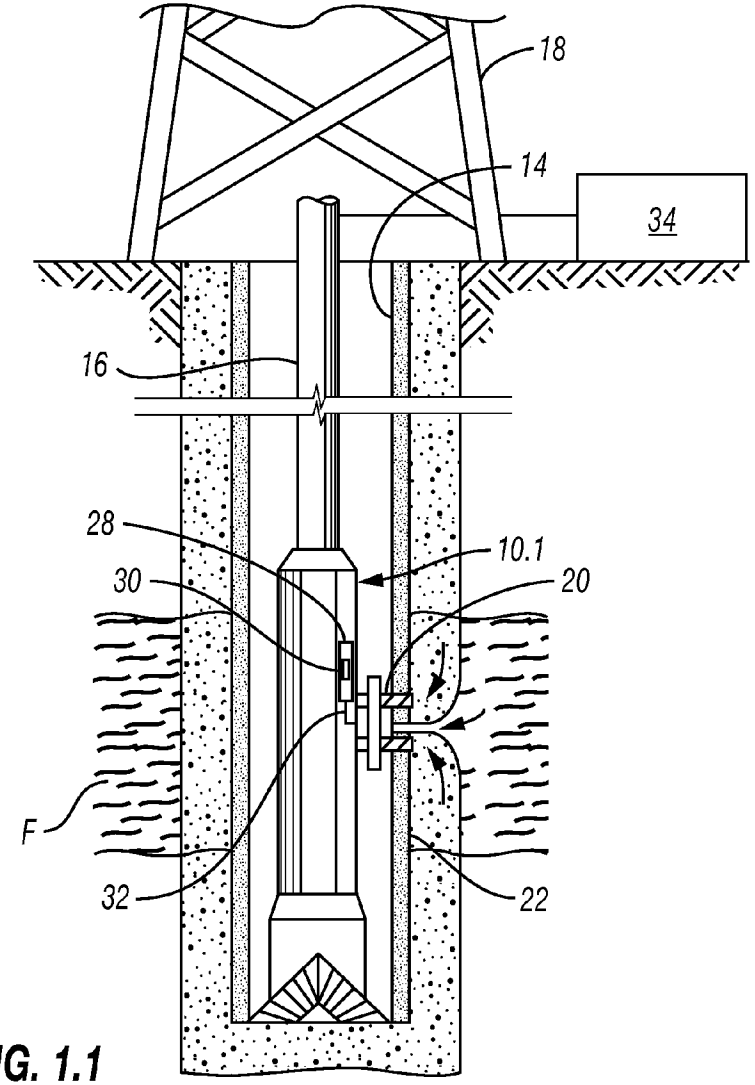
FIG. 1.1

OPTICAL WINDOW ASSEMBLY FOR AN OPTICAL SENSOR OF A DOWNHOLE TOOL AND METHOD OF USING SAME

BACKGROUND

The present disclosure relates generally to wellsite operations. In particular, the present disclosure relates to formation evaluation involving testing, measuring, sampling, monitoring and/or analyzing downhole fluids using, for example, optical sensors.

Wellbores are drilled to locate and produce hydrocarbons. A downhole drilling tool with a bit at an end thereof is advanced into the ground to form a wellbore. As the drilling tool is advanced, drilling mud is pumped through the drilling tool and out the drill bit to cool the drilling tool and carry away cuttings. The fluid exits the drill bit and flows back up to the surface for recirculation through the drilling tool. The drilling mud is also used to form a mudcake to line the wellbore.

During or after a drilling operation, various downhole evaluations may be performed to determine characteristics of the wellbore and surrounding formations. In some cases, the drilling tool may be provided with devices to test and/or sample the surrounding formation and/or fluid contained in reservoirs therein. In some cases, the drilling tool may be removed and a downhole wireline tool may be deployed into the wellbore to test and/or sample the formation. These samples or tests may be used, for example, to determine whether valuable hydrocarbons are present. Production equipment may be positioned in the wellbore to draw located hydrocarbons to the surface.

Formation evaluation may involve drawing fluid from the formation into the downhole tool for testing and/or sampling. Various devices, such as probes or packers, may be extended from the downhole tool to establish fluid communication with the formation surrounding the wellbore and to draw fluid into the downhole tool. Downhole tools may be provided with fluid analyzers and/or sensors to measure downhole parameters, such as fluid properties. Examples of downhole tools are provided in U.S. Pat. No. 7,458,252, the entire contents of which are hereby incorporated by reference. The downhole tool may also be provided with sensors, such as optical sensors, for measuring downhole parameters. Examples of sensors are provided in Nos. 2007/0108378 U.S. Pat. Nos. 5,167,149, 5,167,149, 5,201,220, 5,331,156, and 7,687,770, the entire contents of which are hereby incorporated by reference.

SUMMARY

In at least one aspect, the disclosure relates to an optical window assembly of an optical sensor of a downhole tool positionable in a wellbore penetrating a subterranean formation. The downhole tool has a housing with a flowline there through to receive downhole fluid therein. The optical sensor is positioned about the flowline to measure light passing there through. The optical window assembly includes a tubular sensor body positioned in the housing (the sensor body having a sensor-end and a flanged signal-end with a passage there through), an optical window positioned in the passage of the sensor body to pass the light from the flowline to the optical sensors, a seal disposed about the sensor body, and a backup ring disposed about the sensor body between the flanged signal-end and the seal to support the seal about the sensor body whereby the downhole fluid is prevented from leaking between the seal and the sensor body.

The sensor body has a tapered inner surface. The optical window assembly may also include a brazing between the optical window and the sensor body. The seal may be an o-ring. The backup ring may be made of polyether ether ketone. The sensor body may be made of a non-metallic material. The optical window may include a metalized sapphire. A leakage gap may be defined between the seal and the housing.

In another aspect, the disclosure relates to a downhole tool positionable in a wellbore penetrating a subterranean formation. The downhole tool includes a housing with a flowline to receive downhole fluid therein, a light source to pass light through the flowline, a pair of optical sensors positioned in the housing to measure the light passing through the flowline, and a pair of optical window assemblies operatively connectable to the pair of optical sensors. Each of the optical window assemblies includes a tubular sensor body positioned in the housing (the sensor body having a sensor-end and a flanged signal-end with a passage there through), an optical window positioned in the passage of the sensor body to pass the light from the flowline to the optical sensors, a seal disposed about the sensor body, and a backup ring disposed about the sensor body between the flanged signal-end and the seal to support the seal about the sensor body whereby the downhole fluid is prevented from leaking between the seal and the sensor body.

The downhole tool may also include a spacer positionable between the optical sensors, an optical converter operatively connectable to the optical sensors, fiber optics to operatively connect the optical sensors to the optical converter and the light source. The optical converter may include a lens, a filter, and a photo diode. The housing may include a chassis layer and at least one additional layer about the chassis layer. The chassis layer may have the optical sensors and the optical window assemblies therein. The downhole tool may also include at least one downhole sensor, a surface unit and/or a downhole unit operatively connectable to the optical sensors to receive measurements therefrom.

Finally, in another aspect, the disclosure relates to a method of sensing downhole parameters of downhole fluid about a wellbore penetrating a subterranean formation. The method involves deploying a downhole tool into the wellbore. The downhole tool includes a housing with a flowline there through, a light source, a pair of optical sensors positioned in the housing, and a pair of optical window assemblies operatively connectable to the pair of optical sensors. Each of the optical window assemblies includes a tubular sensor body positioned in the housing (the sensor body having a sensor-end and a flanged signal-end with a passage there through), an optical window positioned in the passage of the sensor body, a seal disposed about the sensor body, and a backup ring disposed about the sensor body between the flanged signal-end and the seal. The method may also involve measuring light passing through downhole fluid in the flowline and through the optical window with the optical sensors and preventing the downhole fluid from leaking between the seal and the sensor body by supporting the seal about the sensor body with the backup ring.

The method may also involve receiving downhole fluid in the downhole tool through the flowline, passing light from the light source through the flowline and the optical window and to the optical sensors, and/or absorbing forces of the downhole fluid against a tapered inner surface of the sensor body.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the optical fluid analyzer calibration method are described with reference to the following figures. The same numbers are used throughout the figures to reference like features and components.

FIGS. 1.1 and 1.2 depict schematic views, partially in cross-section, of a wellsite with a downhole drilling tool and a downhole wireline tool, respectively, with an optical sensor assembly in accordance with embodiments of the present disclosure;

DETAILED DESCRIPTION

Figure 2:
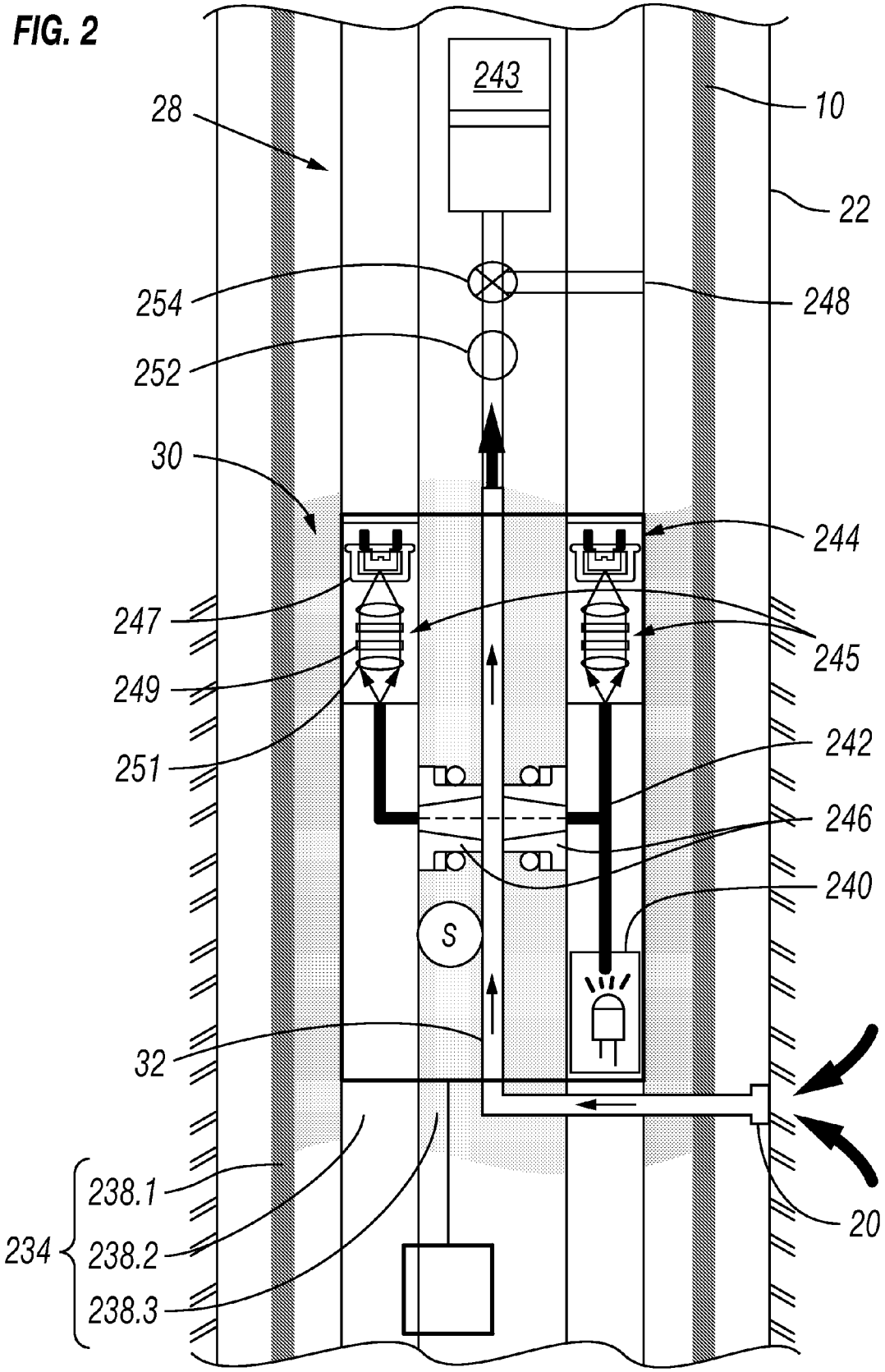
FIG. 2 depicts schematic views illustrating a portion of a downhole wireline tool having an optical sensor assembly therein in accordance with embodiments of the present disclosure.

The description that follows includes exemplary apparatuses, methods, techniques, and instruction sequences that embody techniques of the inventive subject matter. However, it is understood that the described embodiments may be practiced without these specific details.

The present disclosure relates to a downhole optical window assembly usable with optical sensors positioned about a downhole tool for measuring parameters of downhole fluids. The optical window assembly includes a sensor body (e.g., a ceramic body) with an optical (e.g., sapphire) window therein, and a seal and backup ring thereabout. The optical window may be metalized (e.g., sapphire) and tapered to absorb force applied thereto. The backup ring supports the seal about the sensor body to prevent fluid from passing there between and to permit fluid to pass through a leakage gap between the optical window assembly and the downhole tool.

The optical window assembly is configured to control and/or restrict fluid leakage thereabout. The optical window assembly may be capable of use in environments having pressures of up to, for example, about 30 Kpsi (2413.7 Bar) or more. The configuration of the optical window assembly may also be used to reduce the size of the optical window and/or to increase the light intensity used with the optical window assembly.

'Formation evaluation' as used herein relates to the measurement, testing, sampling, and/or other analysis of wellsite materials, such as gases, fluids and/or solids. Such formation evaluation may be performed at a surface and/or downhole location to provide data, such as downhole parameters (e.g., temperature, pressure, permeability, porosity, seismic, etc.), material properties (e.g., viscosity, composition, density, etc.), and the like.

'Fluid analysis' as used herein relates to a type of formation evaluation of downhole fluids, such as wellbore, formation, reservoir, and/other fluids located at a wellsite. Fluid analysis may be performed by a fluid analyzer capable of measuring fluid properties, such as viscosity, composition, density, temperature, pressure, flow rate, optical parameters, etc. Fluid analysis may be performed using, for example, optical sensors (e.g., spectrometers), gauges (e.g., quartz), densitometers, viscometers, resistivity sensors, nuclear sensors, and/or other fluid measurement and/or detection devices.

FIGS. 1.1 and 1.2 depict environments in which subject matter of the present disclosure may be implemented. FIG. 1.1 depicts a downhole drilling tool 10.1 and FIG. 1.2 depicts a downhole wireline tool 10.2 that may be used for performing formation evaluation. The downhole drilling tool 10.1 may be advanced into a subterranean formation F to form a wellbore 14. The downhole drilling tool 10.1 may be conveyed alone or among one or more (or itself may be a) measurement-while-drilling (MWD) drilling tools, a logging-while-drilling (LWD) drilling tools, or other drilling tools. The downhole tool 10.1 is attached to a conveyor (e.g., drillstring) 16 driven by a rig 18 to form the wellbore 14. The downhole tool 10.1 includes a probe 20 adapted to seal with a wall 22 of the wellbore 14 to draw fluid from the formation F into the downhole tool 10.1 as depicted by the arrows.

The downhole drilling tool 10.1 may be withdrawn from the wellbore 14, and the downhole wireline tool 10.2 of FIG. 1.2 may be deployed from the rig 18 into the wellbore 14 via conveyance (e.g., a wireline cable) 16. The downhole wireline tool 10.1 is provided with the probe 20 adapted to seal with the wellbore wall 22 and draw fluid from the formation F into the downhole tool 10.2. Backup pistons 24 may be used to assist in pushing the downhole tool 10.2 and probe 20 against the wellbore wall 22 and adjacent the formation F.

The downhole tools 10.1, 10.2 may also be provided with a formation evaluation tool 28 with an optical sensor assembly 30 for measuring parameters of the formation fluid drawn into the downhole tool 10.1, 10.2. The formation evaluation tool 28 includes a flowline 32 for receiving the formation fluid from the probe 20 and passing the fluid to the optical sensor assembly 30 for measurement as will be described more fully herein. A surface unit 34 may be provided to communicate with the downhole tools 10.1, 10.2 for passage of signals (e.g., data, power, command, etc.) therebetween.

While FIGS. 1.1 and 1.2 depict specific types of downhole tools 10.1 and 10.2, any downhole tool capable of performing formation evaluation may be used, such as drilling, coiled tubing, wireline or other downhole tool. Also, while FIGS. 1.1 and 1.2 depict one optical sensor assembly 30 in a downhole tool, it will be appreciated that one or more optical sensor assemblies 30 and/or other sensors may be positioned at various locations about the downhole tool and/or wellbore. Data and test results from various locations and/or using various methods and/or apparatuses may be analyzed and compared.

FIG. 2 is a schematic view of a portion of downhole tool 10 which may be either of the downhole tools 10.1 or 10.2 form FIGS. 1.1 and 1.2. The probe 20 may be extended from the downhole tool 10.2 for engagement with the wellbore wall 22. The downhole tool 10 includes a tool housing 234 which may include one or more housing layers, such as a drill collar 238.1, mandrel 238.2, and chassis 238.3 as shown and/or other layers.

The formation evaluation tool 28 may be provided with one or more flowlines 32 for drawing fluid into the downhole tool 10 through the probe 20. While one probe 20 is depicted, one or more probes, dual packers and related inlets may be provided to receive downhole fluids and pass them to one or more flowlines 32 (e.g., a high pressure flowline). Examples of downhole tools and fluid communication devices, such as probes, that may be used are depicted in U.S. Pat. No. 7,458,252, previously incorporated herein.

The flowline 32 extends into the downhole tool 10 to pass downhole fluid to the formation evaluation tool 28. The formation evaluation tool 28 may be used to analyze, test, sample and/or otherwise evaluate the downhole fluid. The optical assembly 30 is positioned about the flowline 32 and exposed to the downhole fluid passing therethrough.

The optical sensor assembly 30 includes a light source 240 (e.g., a halogen lamp), an optical fiber 242, an optical converter 244, a pair of optical sensors 245, and a pair of optical window assemblies 246. In some cases, the light source 240 may be integral with the optical sensor(s) 245. The optical fiber 242 operatively connects the light source 240, the optical converter 244, and/or the optical sensors 245. The optical converter 244 includes a lens 247, a filter 249, and a photo diode 251.

The light source 240 passes light through the optical window assemblies 246 and the flowline 32 therebetween. The optical sensors 245 measure light passing through the fluid between the optical window assemblies 246. The optical sensors 245 may measure, for example, intensity of the light passing through the fluid. Changes in intensity may be measurable and used to determine fluid parameters of the downhole fluid. A signal containing the measurements is passed through the lens 247, filter 249 and photo diode 251.

A sample chamber 243 is also coupled to the flowline 32 for receiving the downhole fluid. Fluid collected in the sample chamber 243 may be collected therein for retrieval at the surface, or may be exited through an outlet 248 in housing 234 of the downhole tool 10. Optionally, flow of the downhole fluid into and/or through the downhole tool 10 may be manipulated by one or more flow control devices, such as a pump 252, the sample chamber 246, valves 254 and/or other devices.

One or more downhole sensors S may optionally be provided to measure various downhole parameters and/or fluid properties. The downhole sensor(s) may include, for example, gauges (e.g., quartz), densitometers, viscometers, resistivity sensors, nuclear sensors, and/or other measurement and/or detection devices capable of taking downhole data relating to, for example, downhole conditions and/or fluid properties.

Optionally, a surface and/or downhole unit 34 may be provided to communicate with the formation evaluation tool 28, the optical assembly 30, and/or other portions of the downhole tool 10 for the passage of signals (e.g., data, power, command, etc.) therebetween. These units 34 may include, for example, a measurement while drilling tool, a logging while drilling tool, a processor, a controller, a transceiver, a power source and other features for operating and/or communication with the formation evaluation tool 28 and/or the optical assembly 30.

The surface and/or downhole unit 34 may include, for example, a database and a processor for collecting and analyzing the downhole measurements. As fluids are drawn from the formation into the formation evaluation tool 28 by the probe 20. The fluids may be analyzed by directing light at the fluids and detecting the spectrum of the transmitted and/or backscattered light. Information may be collected and/or processed (e.g., based on information in the database relating to different spectra) in order to characterize the formation fluids. In an example, light may be reflected from a window/fluid flow interface at certain specific angles to determine the presence of gas in the fluid flow. In another example, optical density (OD) measurements of the fluid stream may be taken at certain predetermined energies, and oil and water fractions of a two-phase fluid stream quantified. Examples of analysis are provided in U.S. Pat. Nos. 5,167,149; 5,201,220; and 5,331,156 previously incorporated by reference herein.

Figure 3A:
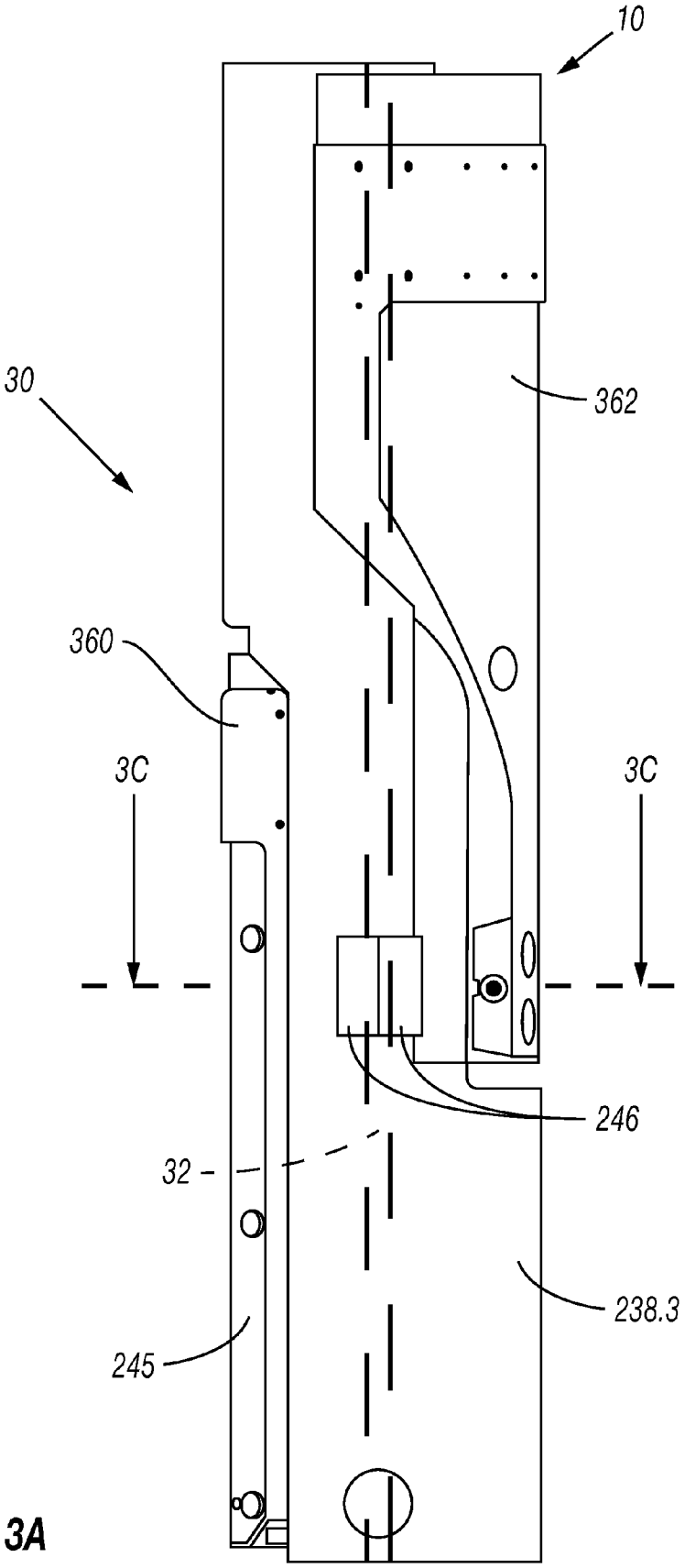
FIGS. 3A-3C are schematic, assembly and cross-sectional views illustrating a portion of a downhole tool having an optical sensor assembly therein in accordance with embodiments of the present disclosure.
Figure 3B:
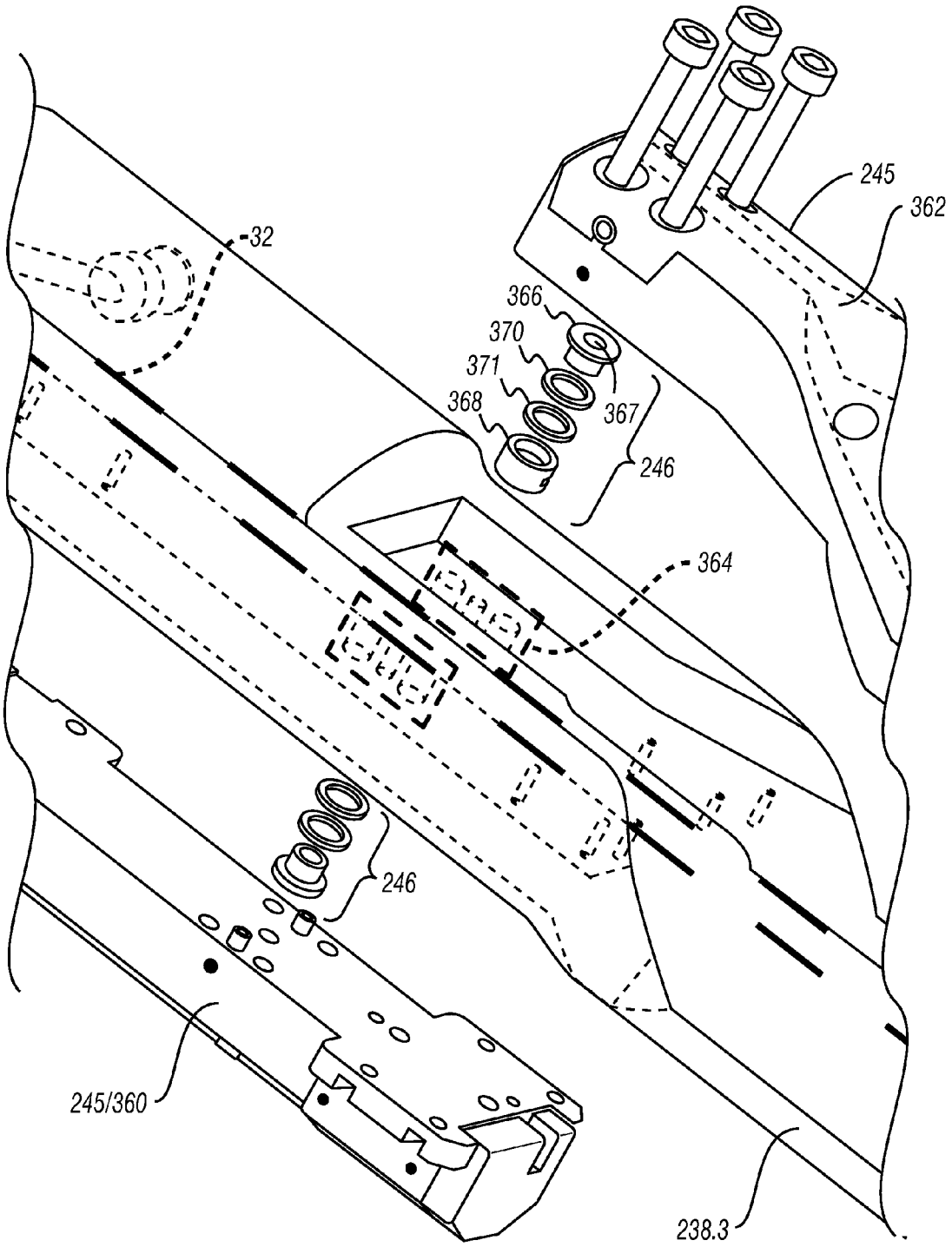
Figure 3C:
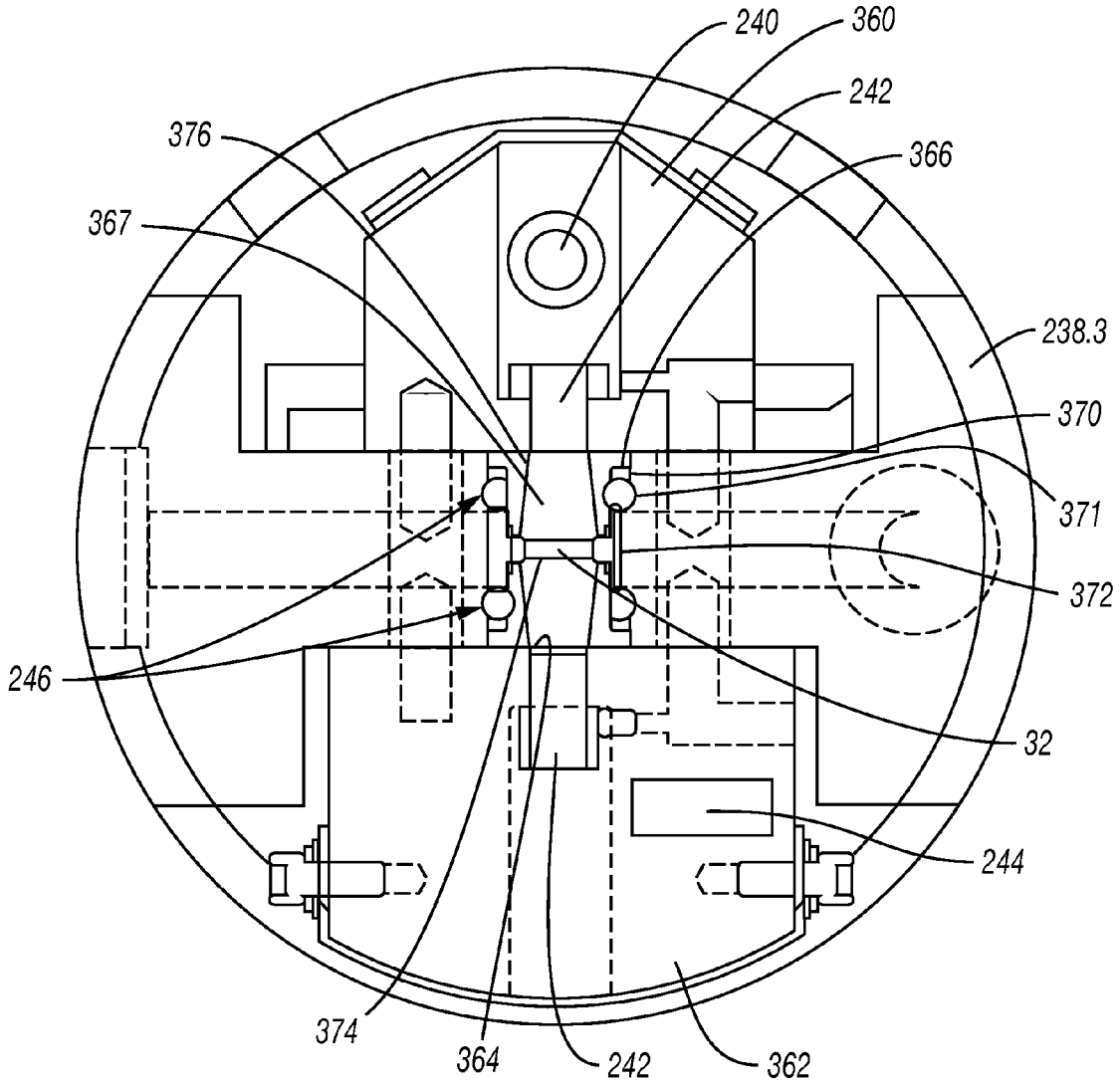

FIGS. 3A-3C depict various views of a portion of the downhole tool 10 with the optical sensor assembly 30 therein. FIG. 3A shows an exterior view of the downhole tool 10. FIG. 3B shows an exploded view of the downhole tool 10. FIG. 3C shows a cross-sectional view of the downhole tool 10 of FIG. 3A taken along line 3C-3C.

As shown in these figures, the light source 240 and the optical fibers 242 may be positioned within and/or about a light housing 360, and attached to the chassis layer 238.3 inside the downhole tool 10. As shown in this view, the light housing 360 and the optical sensor 245 are integral. The optical converter 244 may also be packaged in a converter housing 362 and attached to the chassis layer 238.3 inside the downhole tool 10.

The chassis layer 238.3 may have the flowline 32 passing therethrough and a sensor receptacle 364 for receiving the optical sensors 245 and light housing 360 therein. The optical sensors 245 and light housing 360 are positioned in the sensor receptacles 364 of the chassis layer 238.3 about the flowline 32. The optical sensors 245 are operatively connected to the light source 240 and the optical converter 244 by the optical fibers 242.

As also shown in FIGS. 3B and 3C, the optical window assemblies 246 are positioned adjacent the optical sensors 245. The optical window assemblies 246 include a tubular body 366, an optical window 367, a backup ring 370, and a seal 371. The optical window assemblies 246 are positioned in the sensor receptacle 364 of the chassis layer 238.3. The optical window assemblies 246 have a spacer 372 therebetween to support the optical window assemblies 246 about flowline 32.

Each optical window assembly 246 has a sensing end 374 positioned about the flowline 32 and a flanged signal-end 376 operatively coupled to the optic fiber 242. The tubular body 366 has the backup ring 370 and seals 371 thereabout to prevent leakage of fluid there between. Fluid may be permitted to leak between the optical window assembly 246 and the chassis layer 238.3.

Figure 4A:
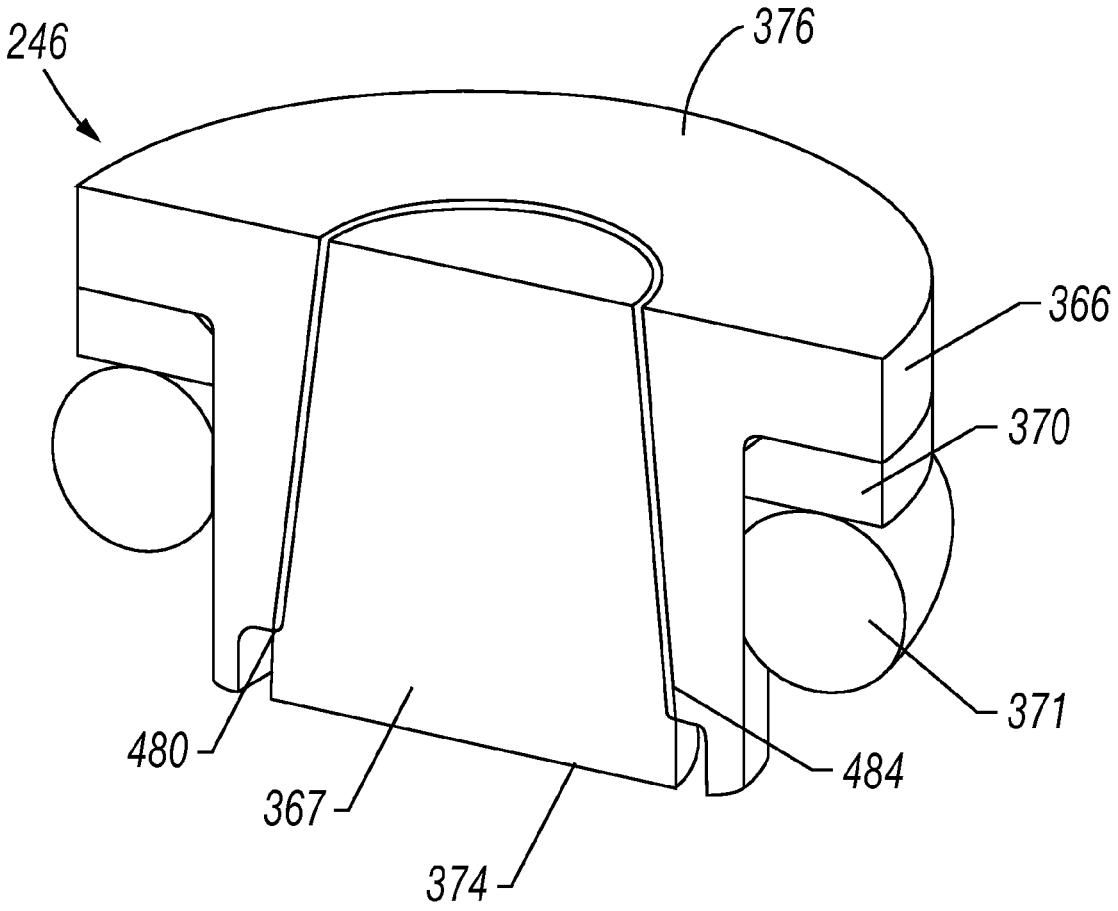
FIGS. 4A-4B are schematic plan and perspective views of a cross-section of an optical window assembly in accordance with embodiments of the present disclosure.
Figure 4B:
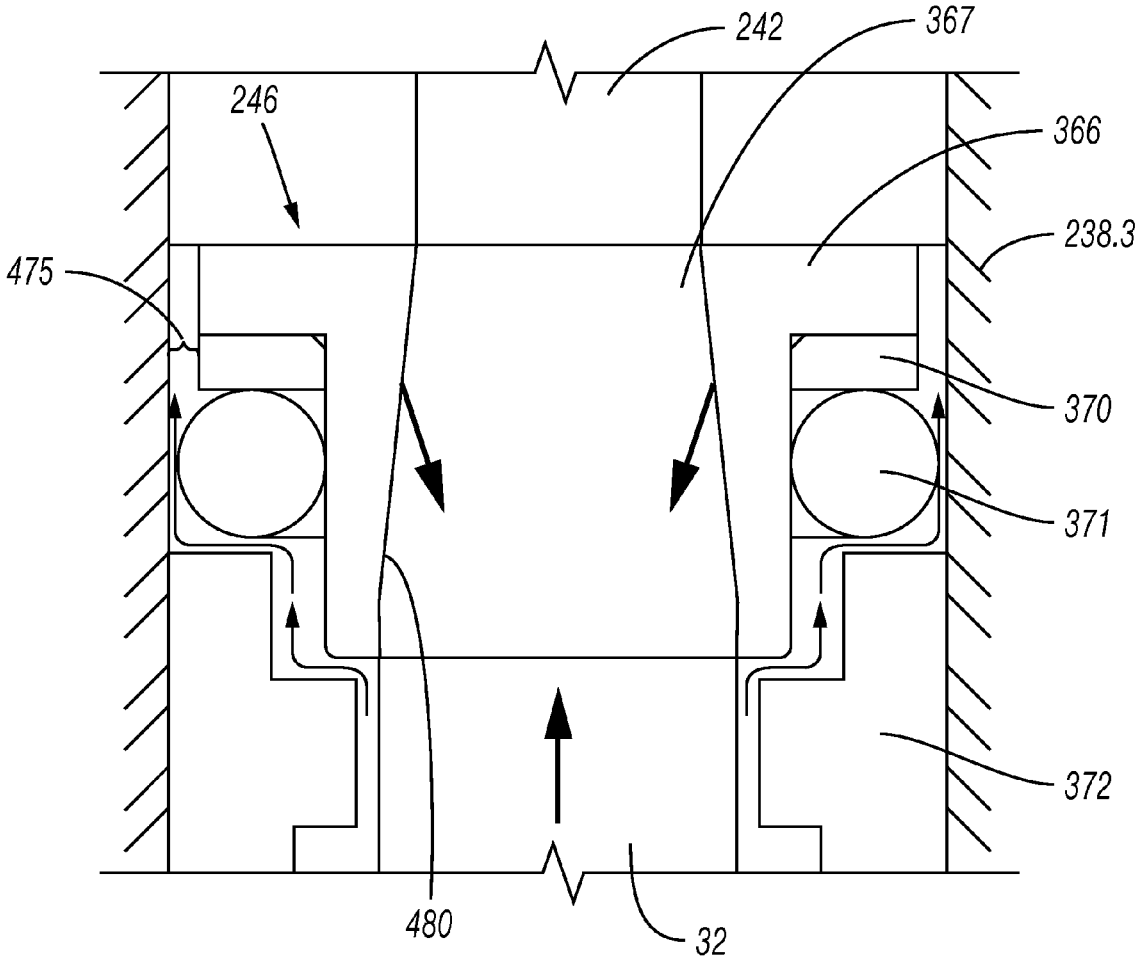

FIGS. 4A and 4B depict additional views of the optical window assembly 246. As shown in FIG. 4A, the tubular body 366 includes has the optical window 367 therein. The tubular body 366 is generally tubular with a tapered inner surface 480 extending from the flanged signal-end 376 to the sensor-end 374. The inner surface 480 tapers such that the inner surface increases in diameter as the inner surface extends away from the flanged signal-end 376.

The tubular body 366 may be of titanium or a non-metallic material, such as a ceramic body. The optical window 367 may be made of a metallic material, such as a metalized sapphire. A brazing layer 484 may be provided between the tubular body 366 and the optical window 367. The optical window 367 may be connected via a brazing process to the tubular body 366. The optical window 367 may be, for example, a metalized sapphire window. Examples of sapphire windows are provided in US Publication No. 2007/0108378, previously incorporated by reference herein.

The backup ring 370 and seal 371 are positioned about an outer surface of the tubular body 366. The backup ring 370 is positioned adjacent the flanged signal-end 376. The seal 371 is positioned adjacent the backup ring 370. The backup ring 370 may be made of, for example, a non-metallic material, such as PEEK (polyether ether ketone). The seal 371 may be, for example, an o-ring made of an elastomateric material. Additional seals may optionally be provided.

FIG. 4B shows the flow of fluid from the flowine 32 and about the optical window assembly 246. The fluid may be high pressure of up to about 30 Kpsi (2413.7 Bar) or more. As shown in FIG. 4B, the optical window assembly 246 may be configured to restrict and/or direct fluid flow thereabout. For example, the optical window assembly 246 may be used to seal pressure for passage of light from the light source therethrough during measurement. The inner surface 480 of the tubular body 366 is tapered to absorb force from hydraulic pressure of fluid passing therein. The taper of the inner surface 480 may be provided at a desired shape and angle to deflect at least some of the hydraulic fluid pressure.

The backup ring 370 is disposed about the tubular body 366 between the flanged signal-end 376 and the seal 371 to support the seal 371 about the tubular body 366 and to prevent fluid from leaking there between. The backup ring 370 may support the seal 371 about the outer surface of the tubular body 366 and spacer 372 to restrict fluid flow there between. Fluid from flowline 32 passes in a leakage gap 475 between the optical window assembly 246 and the chassis layer 238.3 as indicated by the arrows. The leakage gap 475 may extend about a periphery of the optical window assembly 246. Fluid is prevented from passing between the outer surface of the tubular body 366 and the seal 371 or the backup ring 370. This configuration may be used to direct leakage paths to a single path between the optical window assembly 246 and the chassis layer 238.3 and/or to eliminate additional leakage paths thereabout.

Figure 5:
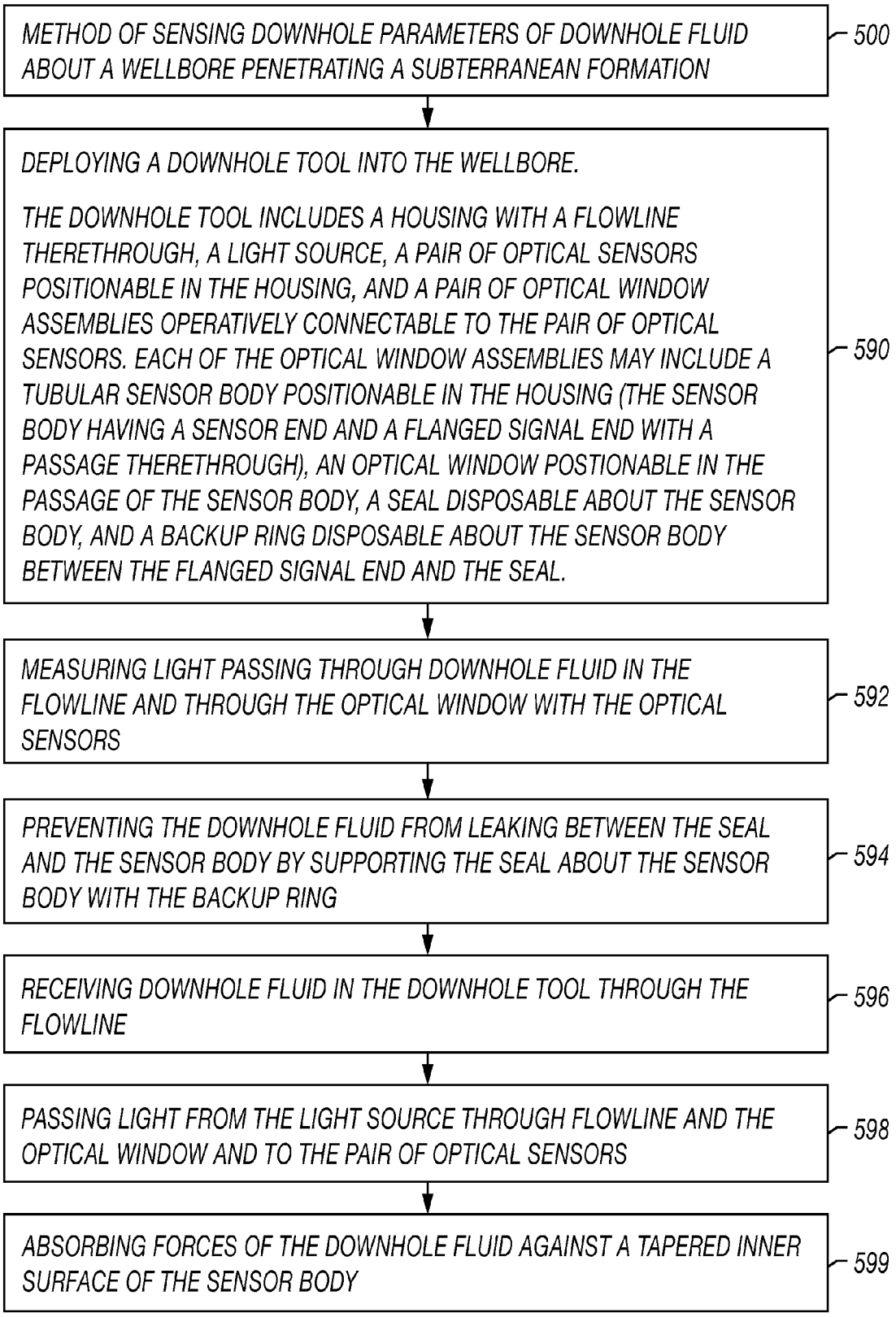
FIG. 5 is a flow chart illustrating a method of sensing downhole parameters in accordance with embodiments of the present disclosure.

FIG. 5 depicts a method 500 of sensing downhole parameters of downhole fluid about a wellbore penetrating a subterranean formation. The method involves deploying (590) a downhole tool into the wellbore. The downhole tool may include a housing with a flowline there through, a light source, a pair of optical sensors positioned in the housing, and a pair of optical window assemblies operatively connectable to the pair of optical sensors (e.g., as in FIGS. 2-3C). Each of the optical window assemblies may include a tubular sensor body positioned in the housing (the sensor body having a sensor-end and a flanged signal-end with a passage there through), an optical window positioned in the passage of the sensor body, a seal disposed about the sensor body, and a backup ring disposed about the sensor body between the flanged signal-end and the seal. The method may also involve measuring (592) light passing through downhole fluid in the flowline and through the optical window with the optical sensors and preventing (594) the downhole fluid from leaking between the seal and the sensor body by supporting the seal about the sensor body with the backup ring.

The method may also involve, for example, receiving (596) downhole fluid in the downhole tool through the flowline, passing (598) light from the light source through flowline and the optical window and to the pair of optical sensors, and/or absorbing (599) forces of the downhole fluid against a tapered inner surface of the sensor body.

The method may be performed in any order, and repeated as desired.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An optical window assembly of an optical sensor of a downhole tool positionable in a wellbore penetrating a subterranean formation, the downhole tool having a housing with a flowline through the housing to receive downhole fluid in the flowline, the optical sensor is positioned about the flowline to measure light passing through the flowline, the optical window assembly comprising:

a tubular sensor body positioned in the housing, the sensor body having a sensor-end and a flanged signal-end with a passage through the sensor body;

an optical window positioned in the passage of the sensor body to pass the light from the flowline to the optical sensor;

a seal disposed about the sensor body; and a backup ring disposed about the sensor body between the flanged signal-end and the seal to support the seal about the sensor body whereby the downhole fluid is prevented from leaking between the seal and the sensor body.

2. The optical window assembly of claim 1, wherein the sensor body has a tapered inner surface.

3. The optical window assembly of claim 1, further comprising a brazing between the optical window and the sensor body.

4. The optical window assembly of claim 1, wherein the seal is an o-ring.

5. The optical window assembly of claim 1, wherein the backup ring comprises polyether ether ketone.

6. The optical window assembly of claim 1, wherein the sensor body comprises a non-metallic material.

7. The optical window assembly of claim 1, wherein the optical window comprises a metalized sapphire.

8. The optical window assembly of claim 1, wherein a leakage gap is defined between the seal and the housing.

9. A downhole tool positionable in a wellbore penetrating a subterranean formation, the downhole tool comprising:

a housing with a flowline to receive downhole fluid in the flowline;

a light source to pass light through the flowline;

a pair of optical sensors positioned in the housing to measure the light passing through the flowline; and a pair of optical window assemblies operatively connectable to the pair of optical sensors, each of the pair of optical window assemblies comprising:

a tubular sensor body positioned in the housing, the sensor body having a sensor-end and a flanged signal-end with a passage through the sensor body;

an optical window is positioned in the passage of the sensor body to pass the light from the flowline to the at least one of the pair of optical sensors;

a seal disposed about the sensor body; and a backup ring disposed about the sensor body between the flanged signal-end and the seal to support the seal about the sensor body whereby the downhole fluid is prevented from leaking between the seal and the sensor body.

10. The downhole tool of claim 9, further comprising a spacer positioned between the pair of optical sensors.

11. The downhole tool of claim 9, further comprising an optical converter operatively connectable to the pair of optical sensors.

12. The downhole tool of claim 11, further comprising fiber optics to operatively connect the pair of optical sensors to the optical converter and the light source.

13. The downhole tool of claim 11, wherein the optical converter comprises a lens, a filter, and a photo diode.

14. The downhole tool of claim 9, wherein the housing comprises a chassis layer and at least one additional layer about the chassis layer, the chassis layer having the pair of optical sensors and the pair of optical window assemblies in the chassis layer.

15. The downhole tool of claim 9, further comprising at least one downhole sensor.

16. The downhole tool of claim 9, further comprising at least one of a surface unit and a downhole unit operatively connectable to the pair of optical sensors to receive measurements from the pair of optical sensors.

17. A method of sensing downhole parameters of downhole fluid about a wellbore penetrating a subterranean formation, the method comprising:

deploying a downhole tool into the wellbore, the downhole tool comprising a housing with a flowline through the housing, a light source, a pair of optical sensors positioned in the housing, and a pair of optical window assemblies operatively connectable to the pair of optical sensors, each of the optical window assemblies comprising:

a tubular sensor body positioned in the housing, the sensor body having a sensor-end and a flanged signal-end with a passage through the sensor body;

an optical window positioned in the passage of the sensor body;

a seal disposed about the sensor body; and a backup ring disposed about the sensor body between the flanged signal-end and the seal; and measuring light passing through downhole fluid in the flowline and through the optical window with the pair of optical sensors; and preventing the downhole fluid from leaking between the seal and the sensor body by supporting the seal about the sensor body with the backup ring.

18. The method of claim 17, further comprising receiving downhole fluid in the downhole tool through the flowline.

19. The method of claim 17, further comprising passing light from the light source through the flowline and the optical window and to the pair of optical sensors.

20. The method of claim 17, further comprising absorbing forces of the downhole fluid against a tapered inner surface of the sensor body.

* * * * *